United States Patent [19]

Hage

[11] 4,050,805

[45] Sept. 27, 1977

[54] ELECTROPHOTOGRAPHIC COPYING APPARATUS FOR TWO-SIDED COPYING

[75] Inventor: Charles Thomas Hage, Rochester, N.Y.

[73] Assignee: Eastman Kodak Company, Rochester, N.Y.

[21] Appl. No.: 633,149

[22] Filed: Nov. 18, 1975

[51] Int. Cl.[2] ..... G03G 15/00

[52] U.S. Cl. ..... 355/14; 271/163; 355/24

[58] Field of Search ..... 355/3 R, 3 SH, 14, 23, 355/24, 26; 271/9, 162, 163

[56] References Cited

U.S. PATENT DOCUMENTS

| | | | |
|---|---|---|---|
| 3,599,966 | 8/1971 | Del Vecchio et al. | 271/9 |
| 3,615,129 | 10/1971 | Drawe et al. | 355/3 R |
| 3,630,607 | 12/1971 | Korn et al. | 355/14 X |
| 3,645,615 | 2/1972 | Spear | 355/3 R |
| 3,856,295 | 12/1974 | Looney | 355/3 R X |
| 3,905,697 | 9/1975 | Komori et al. | 355/26 |

*Primary Examiner*—Fred L. Braun

*Attorney, Agent, or Firm*—Lawrence P. Kessler

[57] ABSTRACT

In an electrophotographic copier having a given paper travel path from supply to exit, apparatus to enable the copier to automatically make two-sided copies. An auxiliary tray is positioned to selectively receive copy sheets from the exit hopper during the two-sided copying mode of operation. The tray is pivotable about an axis located just above the primary sheet supply. When it is desired to accomplish two-sided copying, sheets upon which first-side copy have been made are directed into the auxiliary tray with the first-side copy face of the sheets oriented opposite to the original orientation in the primary supply. The tray is then pivoted so that it overlies the primary sheet supply. The sheets in the tray may then be fed by the primary feed mechanism to have the second-side copy made thereon in proper registration.

8 Claims, 4 Drawing Figures

ELECTROPHOTOGRAPHIC COPYING APPARATUS FOR TWO-SIDED COPYING

BACKGROUND OF THE INVENTION

1. Field of the Invention

This invention relates to electrophotographic copiers, and more particularly to an electrophotographic copier capable of automatically making two-sided copies.

2. Description of the Prior Art

It is well known that the almost universal acceptance of electrophotographic copiers has served to greatly facilitate general access to information. At the same time, however, copier usage has not gone totally without creating some ancillary problems such as the burden both on the amount of paper consumed and the space required to store the resultant copies. The paper problem stems in part from the fact that while many documents have printing on both sides of a sheet, many prior art electrophotographic copiers were designed for making copies on only one side of a receiver sheet (hereinafter referred to as one-sided copying).

As is readily apparent, the formation of a copy on both sides of receiver sheets would save both on the amount of paper used as well as the space required for storage. Therefore, several recently introduced plain-paper electrophotographic copiers have provided for simple manual two-sided copying (copying on both sides of a receiver sheet). In order to accomplish this end, receiver sheets on which a copy has been made of the first side of a document (first-side copy) are manually transferred from the exit hopper back to the sheet supply. The side of each sheet on which the copy was made is oriented oppositely to its orientation during initial (first-side copy) feeding. The sheets may then be fed to have the copy of the second side of the document (second-side copy) made thereon. While this method of two-sided copying does not require additional machine structure, it does require an additional manual operational step with some coincident sophistication in operation training to insure proper image registration for copying in the two-sided mode of operation.

An attempt to provide automatic two-sided copying in an electrophotographic copier is shown in U.S. Pat. No. 3,645,615 in the name of Spear, issued Feb. 29, 1972. The first-side copy is made on sheets fed from a main paper supply, the sheets being delivered (after the first-side copy image is fused thereto) to a second paper supply. The second-side copy is then made by feeding the first-side copy sheets from the second paper supply, the sheets being subsequently delivered to the exit hopper after the second-side copy is made. As can be seen in FIGS. 1 and 2 of this patent, two paper feeders, two "entrance" paths and two "exit" paths are required.

SUMMARY OF THE INVENTION

It is the purpose of this invention to provide an electrophotographic copier of simple construction capable of automatically making copies on both sides of a receiver sheet. Accordingly, the copier has a given paper travel path from paper supply to exit, with an auxiliary tray positioned to receive copy sheets from the exit hopper during the two-sided copying mode of operation. The tray is pivotable about an axis located just above the primary sheet supply. When it is desired to accomplish two-sided copying, sheets upon which first-side copy have been made are directed into the auxiliary tray with the first-side copy face of the sheets oriented opposite to the original orientation in the primary supply. The tray is then pivoted so that it overlies the primary sheet supply. The sheets in the tray may then be fed by the primary feed mechanism to have the second-side copy made thereon in proper registration.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
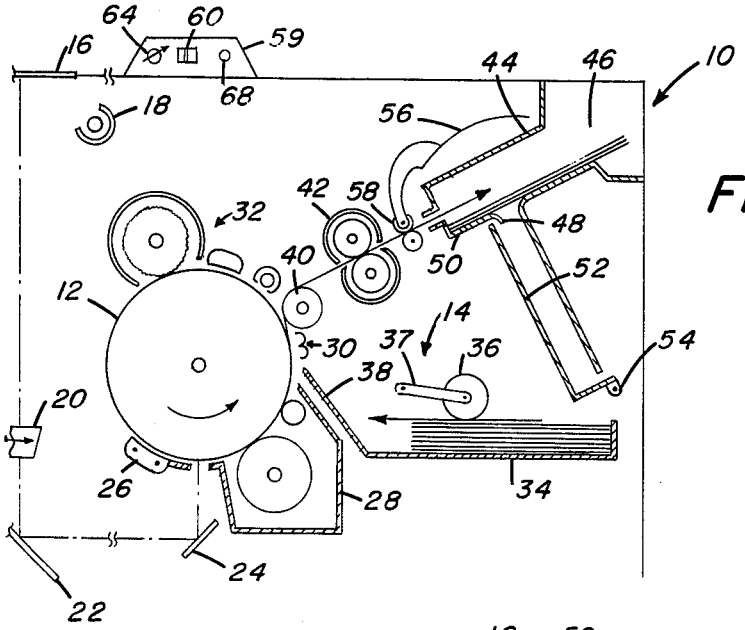
FIG. 1 is a generally schematic side elevational view of an electrophotographic copier incorporating a pivotable auxiliary tray for automatic two-sided copying according to this invention, the copier being shown in its one-sided copying mode of operation.

An electrophotographic copier, designated generally as numeral 10, includes a drum 12 having a photoconductive surface, the drum being rotated in the indicated direction to pass sequentially through a series of electrophotographic processing stations. A paper path arrangement, designated generally as numeral 14, feeds sheets to the drum 12 to receive toned images of an original to be copied. It should, of course, be noted that while a particular copier structure is shown and described, other known arrangements for electrophotographic copiers could be utilized (e.g., flash exposure to photoconductive belt), provided only that the copier includes a receiver sheet path arrangement having a general alignment of the supply and exit hoppers.

The electrophotographic cycle shown involves producing an image of a document placed on a platen 16 by exposing the document to a light source 18 and projecting the reflected document image through a lens 20 via a series of mirrors 22, 24 to the drum 12. The photoconductive surface of the drum 12 receives an electrostatic charge from a corona charger 26 before entering the image exposure area. In the exposure area, the generally uniform charge on the photoconductive surface will be dissipated by exposure to the projected document image to form an electrostatic charge pattern corresponding to the document image. As the drum continues to rotate, the charge pattern which is a latent image of the document is developed in a developing section 28 by contacting that area of the drum containing the charge pattern with oppositely charged toner particles, the toner particles being attracted to the latent image to develop the latent image. The developed image is then transferred to receiver sheets in a transfer section 30 by attracting the developed image to the receiver sheet which has been moved into contact with the image. Any residual toner (from the developed image or background) remaining on the drum is cleaned in a cleaning section 32 before the copy cycle is repeated.

The given paper path 14, which is the same for both one-sided and two-sided copy modes, includes a supply hopper such as primary supply tray 34 in which a stack of receiver sheets is stored. A primary feeder 36 which is shown as being of the scuff type, having a pivotable support arm 37, feeds sheets seriatim from the top of the stack to a guide plate 38 which directs the sheets into intimate contact with drum in proper registration in the transfer section 30 to receive the toned (developed) document image. After transfer of the toned image to the receiver sheets, a sheet stripping roller 40 will detack the image bearing receiver sheets from the drum 12 and direct the sheets to a fusing apparatus 42 where the toned image will be permanently fixed to the sheets. After fusing, the sheets are fed to a receiver hopper, such as exit hopper 44 which has an external opening 46 to permit ready access by the operator to the stacked sheets. The exit hopper 44 is in general vertical alignment with the supply tray 34.

In order for the copier 10 to be able to perform in a two-sided copying mode of operation, an opening 48 is provided in the base 50 of the hopper 44. A deflector 56 is mounted for selective movement about a pivot 58 to a first position (FIGS. 1 and 3) out of the path of receiver sheets entering the hopper 44 and to a second position (FIG. 2) in the path of receiver sheets entering the hopper 44 to deflect the sheets through the opening 48. An auxiliary tray 52 is mounted for selective movement about a pivot 54 to a first position (FIGS. 1 and 2) to receive sheets deflected through the opening 48 and to a second position (FIG. 3) where it overlies the primary supply tray 34. The movement of the deflector 56, the auxiliary tray 52 and the feeder 36 are controlled by the logic diagram shown in FIG. 4 and described hereinbelow.

Figure 2:
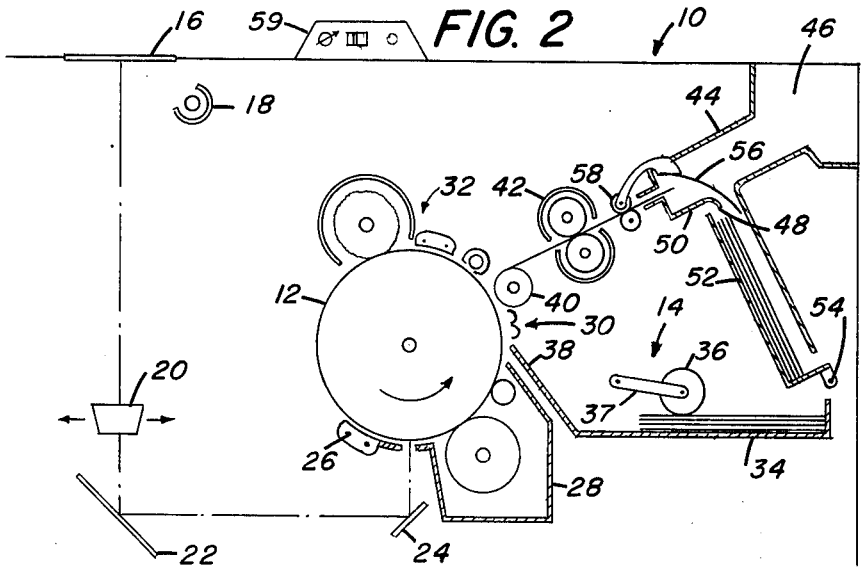
FIG. 2 is a side elevational view similar to FIG. 1, but with the copier in its automatic two-sided copying mode of operation, first-side copy step.

With the structure described, the copier 10 is capable of operation in both a one-sided copy mode and an automatic twosided copy mode. A control panel 59 on the copier 10 has a series of program switches including a mode selection switch 60, a copy number input selector 64, and a start copy switch 68. When the copier 10 is selected to be in its 37 one-sided copy" mode of operation, the paper path configuration 14 is as shown in FIG. 1 with the deflector 56 in its first position out of the exit path. As seen in the logic diagram of FIG. 4, the switch 60 may be positioned to engage contact 62 to indicate selection of the "one-sided copy" mode, and the number of desired copies will be indicated by positioning the input count selector 64 to program the copy count into copy logic 66. The logic 66 may be a minicomputer such as that described for controlling the entire copier cycle in U.S. Pat. No. 3,914,047 in the name of Hunt, et al. issued Oct. 21, 1975.

When the start copy switch 68 is momentarily actuated, a signal is sent to OR gate 98 enabling the gate to activate the start copy input of copy logic 66, causing the logic to start, control and stop the operation of the various processing steps of the copier 10 as the required number of copies indicated by the counter 64 are produced. The contact 62 is connected to the reset input of flip-flops 70, 72 and 74 through OR gates 100, 102 and 104 respectively. The flip-flops are connected through drive amplifiers 82, 84 and 86 to the deflector pivot solenoid 76, tray pivot solenoid 78 and feeder lift solenoid 80 respectively. Resetting of the flip-flops by positioning switch 60 on contact 62 (or by a separate initializing signal from copy logic 66 at time of power on to OR gates 100, 102 and 104) will insure that the solenoids are in a deactivated state. With the paper path 14 configured and the overall logic set as described, receiver sheets will be fed from the primary supply; one-sided copies will be made thereon, and the sheets will be stacked in the exit hopper 44 for easy removal by the operator through the access opening 46.

When automatic two-sided copying is to be accomplished, the switch 60 is moved to the position to engage contact 88 to indicate selection of the "two-side copy" mode of operation. Again the input counter 64 will be set to program the copy logic 66 for the desired number of copies to be made. Momentary actuation of the switch 68 will then begin the copy cycle for the "two-sided copy" mode of operation. The contact 88 is connected to one input of each AND gate 90, 92 and 94, the AND gates being in turn connected to the set inputs of the flip-flops 70, 72 and 74 respectively. While the switch 60 is in engagement with the contact 88, a steady signal will be sent to each of these AND gates.

As the copy logic 66 starts the copy cycle for the first side of the document to be copied, a start signal will be sent to one input of AND gate 106. Since the other AND gate 106 input is connected to the $\overline{Q}$ (reset) output of flip-flop 72, and flip-flop 72 is at this time in its reset state, AND gate 106 is enabled and transmits the signal to the second input of AND gate 90, thus placing this gate in an operative condition, causing it to place flip-flop 70 in its set state. This is turn will provide a signal through the drive amplifier 82 to activate the deflector solenoid 76. The deflector 56 will be moved by the solenoid to its second position to intercept the exit path so that the paper path configuration 14 shown in FIG. 2 will be assumed. As the first side copies are made, the receiver sheets fed into the exit hopper 44 will be directed by the deflector 56 through the opening 48 into the auxiliary tray 52.

Figure 3:
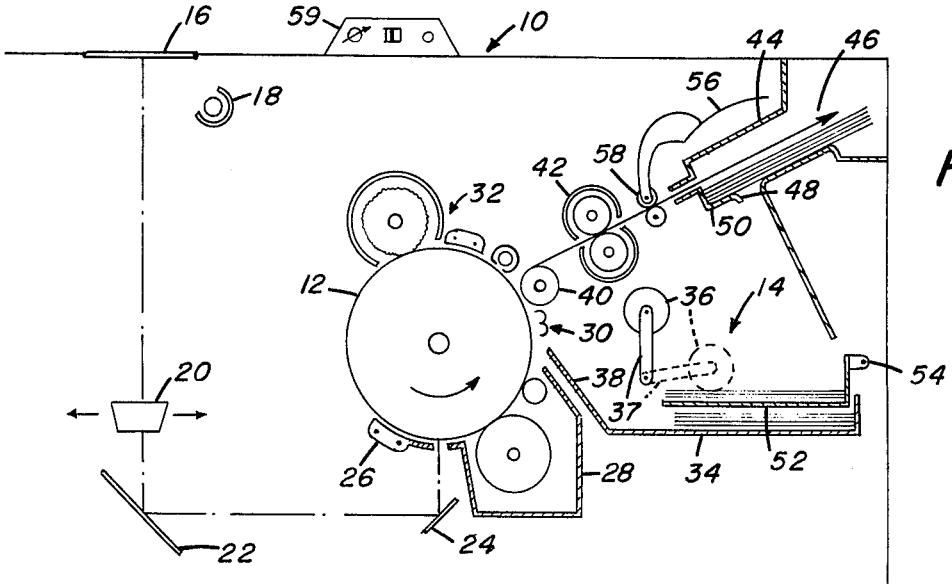
FIG. 3 is a side elevational view similar to FIG. 1, but with the structure in its second-side copy step of the automatic two-sided copying mode of operation.
Figure 4:
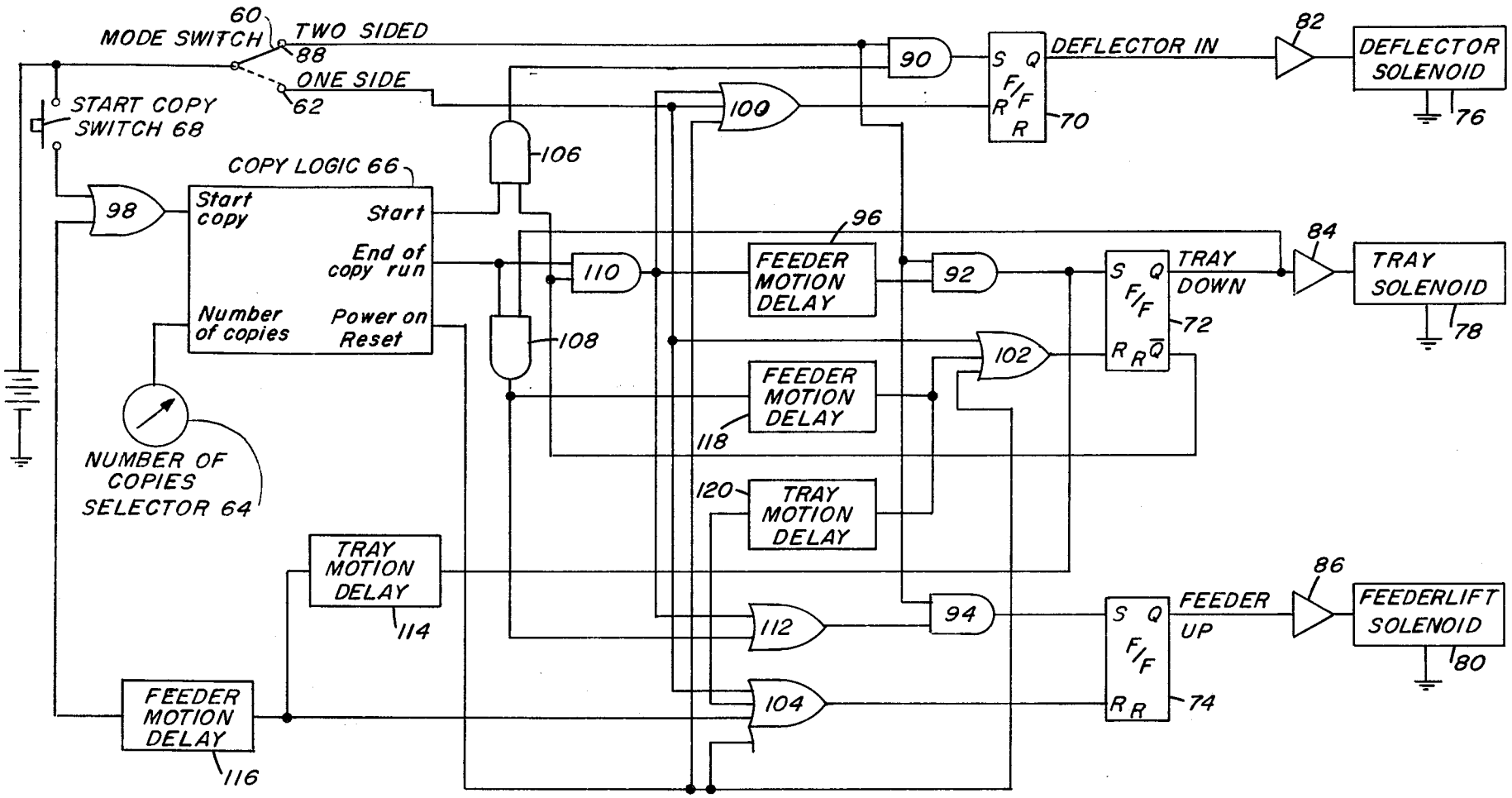
FIG. 4 is a block diagram of the logic for the electrophotographic copier of FIG. 1 providing for automatic two-sided copying according to this invention.

When the end of the first side copy run is reached (requisite number of copies are made), an end of copy run signal will be sent from the copy logic 66 to one input of each of the AND gates 108 and 110. The second inputs of AND gates 108 and 110 are connected to the Q (set) and $\overline{Q}$ (reset) output of flip-flop 72 respectively. Since flip-flop 72 is in its reset state, its Q (set) output is inactive, blocking AND gate 108, and its $\overline{Q}$ (reset) output is active, enabling AND gate 110. The enabling of AND gate 110 transmits the end of copy run signal to OR gates 100 and 112 (enabling these gates) and to the input of delay circuit 96. OR gate 100 now resets flip-flop 70, removing the signal at the input of amplifier 82, causing deactivation of the deflector solenoid 76, thereby returning the deflector 56 to its first position out of the exit path (FIG. 1). OR gate 112 output provides the necessary second input activation of AND gate 94, causing the output of AND gate 94 to transmit a signal to the set input of flip-flop 74, which then assumes its set state, and through drive amplifier 86 in turn activates the feeder lift solenoid 80. The feeder is thus raised to the position shown in FIG. 3. The signal to delay circuit 96 is delayed sufficiently to allow the feeder to assume its raised position and thereafter provides the necessary second input activation of AND gate 92. Upon activation, AND gate 92 transmits the signal to the set input of flip-flop 72, placing the flip-flop in its set state, and to the input of delay circuit 114. Flip-flop 72 now sets and activates the tray solenoid 78 through the drive amplifier 84 to move the tray 52 from its upper position to its lower position, also as shown in FIG. 3. At the same time, the input of AND gate 108 connected to flip-flop 72 Q (set) output will now be activated, and the inputs of AND gate 106 and AND gate 110, connected to flip-flop 72 $\overline{Q}$ (reset) output, will be deactivated, disabling AND gate 106 and AND gate 110.

The signal to delay circuit 114 is delayed sufficiently to allow the tray to assume its lower position and thereafter is transmitted to delay circuit 116 and OR gate 104. OR gate 104 is enabled and in turn activates the reset input of flip-flop 74, causing it to assume its reset state, deactivating drive amplifier 86, thereby de-energizing the feeder lift solenoid 80 so that the feeder 36 may be returned to its feeding position (dotted line position oF FIG. 3). After a sufficient delay to allow the feeder 36 to return to its feeding position, delay circuit 116 transmits the signal to OR gate 98, enabling the OR gate and thereby activating the start copy input of the copy logic 66. The second side copies are now made, and the receiver sheets bearing the second side copies will be stacked in the exit hopper 44, just as the one-sided copies were stacked for easy removal by the operator. As is apparent, when the receiver sheets are delivered to the auxiliary tray 52 from the exit hopper 44, the sheets will have their first copy side face up. Thus when the tray 52 is subsequently placed in position over the primary supply for second side copying, the sheets therein will be fed with their blank face oriented properly to permit second side copies to be made on the blank side of the sheet.

At the end of the second side copy run, an end of copy run signal is transmitted to AND gate 108 and AND gate 110. Since AND gate 110 is disabled while flip-flop 72 is in its set state and AND gate 108 has its other input activated by the Q (set) output of flip-flop 72, AND gate 108 will transmit the signal to OR gate 112 and delay circuit 118. OR gate 112 activates the second input of AND gate 94, causing flip-flop 74 to assume its set state and through drive amplifier 86 energize feeder lift solenoid 80, raising the feeder 36 to its upper position. After a delay sufficient for the feeder 36 to reach its upper position, delay circuits 118 transmits the signal to OR gate 102 and delay circuit 120. OR gate 102 is enabled and causes flip-flop 72 to assume its reset state, deactivating AND gate 108 and drive amplifier 84, thus de-energizing the tray solenoid 78, causing the tray to return to its upper position. After a delay sufficient to allow the tray to clear the path of the feeder 36, delay circuit 120 transmits the signal to OR gate 104, enabling the OR gate and causing flip-flop 74 to assume its reset state, thus deactivating drive amplifier 86 and thereby de-energizing the feeder lift solenoid 80. The feeder now returns to its normal position as shown in FIG. 1. The copier 10 and the copy logic 66 are thus returned to conditions existing before the copy run.

From the foregoing it is apparent that there is herein provided a simplified apparatus for automatically making two-sided electrophotograhpic copies. By placing a pivoting tray in position to selectively receive sheets from the exit hopper and re-locate them with respect to the generally aligned primary supply so that they may be fed for making second-side copies directly on the sheets containing first-side copies, the paper path of the copier apparatus is simplified to require only a single feeder mechanism, "entrance" path, and "exit" path.

The invention has been described in detail with particular reference to the preferred embodiment thereof, but it will be understood that variations and modifications can be effected within the spirit and scope of the invention.

I claim:

1. In a document copier having processing stations for forming copies of documents on discrete sheets which are fed seriatim in a given travel path from a supply hopper through the processing stations to a receiving hopper, means for selectively operating the copier in a two-sided copy mode in which a first-side copy is formed on one side of a discrete sheet during a first-side copy cycle and a second-side copy is formed on the opposite side of the discrete sheet during a second-side copy cycle, comprising: an auxiliary tray selectively movable to a first position adjacent to said receiving hopper for receiving sheets therefrom and to a second position overlying said supply hopper, a deflector selectively movable to a first position intercepting said travel path into said receiving hopper to direct sheets toward said auxiliary tray and to a second position out of said travel path, and control means for positioning said deflector and said auxiliary tray in said first positions during the first-side copy cycle of said two-sided copy mode whereby sheets receiving the first-side copy will be directed into said auxiliary tray, and for positioning said deflector and said auxiliary tray in said second positions during the second-side copy cycle of said two-sided copy mode whereby sheets may be fed from said auxiliary tray along said travel path to have the second side copy made thereon, the sheets thence being delivered to said receiver hopper.

2. The structure of claim 1 wherein said receiving hopper and said supply hopper are in general vertical alignment.

3. The structure of claim 2 wherein said receiving hopper has an opening in the base thereof through which sheets may be directed by said deflector when said deflector is in its first position.

4. The structure of claim 3 wherein said auxiliary tray is mounted for pivotal movement about one end, said one end being located immediately above said supply hopper.

5. The structure of claim 4 wherein the sheets are fed by a scuff feeder which is pivotably mounted for selective movement to a first position overlying said supply hopper for feeding sheets and to a second position removed from said first position.

6. The structure of claim 5 wherein said control means is additionally operative for positioning said scuff feeder in said second position during the time when said auxiliary tray is being moved from its first position to its second position.

7. An electrophotographic copier having selective operating modes for making one-sided or two-sided copies, said two-sided copy mode having a first-side copy cycle during which a first-side copy is formed on one side of a receiver sheet and a second-side copy cycle during which a second-side copy is formed on the opposite side of the receiver sheet, said copier comprising:

a primary supply tray for supporting a stack of receiver sheets;

means for feeding receiver sheets from said primary supply tray;

a series of processing stations for electrophotographically making copies on said receiver sheets;

an exit hopper for accumulating copy containing receiver sheets;

a sheet travel path from said primary supply tray through said electrophotographic processing stations to said exit hopper;

an auxiliary tray selectively movable to a first position adjacent to said exit hopper for receiving sheets therefrom and to a second position overlying said primary supply tray;

diverting means selectively movable to a first position intercepting said sheet travel path in said exit hopper for diverting receiver sheets from said exit hopper to said auxiliary tray when in said first position and to a second position out of said sheet travel path; and control means operative during the one-sided copy mode for positioning said diverting means in said second position and operative during the two-sided copy mode for positioning said diverting means and said auxiliary tray in said first positions to divert sheets into said auxiliary tray during the first-side copy cycle, and positioning said auxiliary tray and said diverting means in said second positions at the end of said first-side copy cycle whereby the sheets in said auxiliary tray may be fed by said feed means to have the second-side copy made thereon, the sheets thence being delivered to the exit hopper.

8. The structure of claim 7 wherein said exit hopper and said primary supply tray are in general vertical alignment and wherein said auxiliary tray is mounted for pivotal movement about one end, said one end being located immediately above said supply hopper.

* * * * *

UNITED STATES PATENT OFFICE

CERTIFICATE OF CORRECTION

Patent No. 4,050,805 Dated September 27, 1977

Inventor(s) Charles T. Hage

It is certified that error appears in the above-identified patent and that said Letters Patent are hereby corrected as shown below:

Col. 6, line 27, Claim 1 - "receiver" should read --- receiving ---.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*